US005259704A

United States Patent [19]

Orgorchock

[11] Patent Number: 5,259,704

[45] Date of Patent: Nov. 9, 1993

[54] MECHANICALLY STABILIZED EARTH SYSTEM AND METHOD OF MAKING SAME

[75] Inventor: John M. Orgorchock, Spring, Tex.

[73] Assignee: Tricon Precast, Inc., Houston, Tex.

[21] Appl. No.: 758,594

[22] Filed: Sep. 12, 1991

Related U.S. Application Data

[63] Continuation-in-part of Ser. No. 610,514, Nov. 8, 1990, abandoned.

[51] Int. Cl.[5] ..... E02D 29/02

[52] U.S. Cl. ..... 405/262; 405/286

[58] Field of Search ..... 405/258, 262, 284, 285, 405/286

[56] References Cited

U.S. PATENT DOCUMENTS

| | | | |
|---|---|---|---|
| 182,819 | 10/1876 | Harsha . | |
| 257,599 | 5/1882 | Lucas . | |
| 1,083,289 | 1/1914 | Mason . | |
| 1,164.558 | 12/1915 | Uhrbrock . | |
| 1,762.343 | 6/1930 | Munster . | |
| 1,786,573 | 12/1930 | Maserang . | |
| 2,601,974 | 7/1952 | Hytte . | |
| 3,535,204 | 10/1970 | Truxa | 162/352 |
| 3,631,682 | 1/1972 | Hilfiker et al. | 61/47 |
| 3,686,873 | 8/1972 | Vidal | 61/39 |
| 3,941,409 | 3/1976 | Rameau | 285/137 |
| 4,068,482 | 1/1978 | Hilfiker | 61/47 |
| 4,116,010 | 9/1978 | Vidal | 405/262 |
| 4,117,686 | 10/1978 | Hilfiker | 405/284 |
| 4,154,554 | 5/1979 | Hilfiker | 405/273 |
| 4,193,718 | 3/1980 | Wahrendorf et al. | 405/286 |
| 4,260,296 | 4/1981 | Hilfiker | 405/284 |
| 4,266,890 | 5/1981 | Hilfiker | 405/286 |
| 4,324,508 | 4/1982 | Hilfiker et al. | 405/284 |
| 4,329,089 | 5/1982 | Hilfiker et al. | 405/262 |
| 4,342,524 | 8/1982 | Anderson | 403/331 |
| 4,343,572 | 8/1982 | Hilfiker | 405/284 |
| 4,389,133 | 6/1983 | Oberst | 403/230 |
| 4,391,557 | 7/1983 | Hilfiker et al. | 405/287 |
| 4,407,611 | 10/1983 | Murray et al. | 405/284 |
| 4,440,527 | 4/1984 | Vidal | 405/284 |
| 4,449,857 | 5/1984 | Davis | 405/286 |
| 4,470,728 | 9/1984 | Broadbent | 405/284 |
| 4,505,621 | 3/1985 | Hilfiker et al. | 405/284 |
| 4,529,174 | 7/1985 | Pickett | 256/27 |
| 4,616,959 | 10/1986 | Hilfiker | 405/286 |
| 4,653,962 | 3/1987 | McKittrick et al. | 405/286 |
| 4,661,023 | 4/1987 | Hilfiker | 405/262 |
| 4,684,287 | 8/1987 | Wojciechowski | 404/6 |
| 4,725,170 | 2/1988 | Davis | 405/286 |
| 4,790,690 | 12/1988 | Vidal et al. | 405/262 |
| 4,824,293 | 4/1989 | Brown et al. | 405/284 |
| 4,834,584 | 5/1989 | Hilfiker | 405/262 |
| 4,929,125 | 5/1990 | Hilfiker | 405/262 |
| 4,952,098 | 8/1990 | Grayson et al. | 405/262 |
| 4,993,879 | 2/1991 | Hilfiker | 405/262 |

*Primary Examiner*—David H. Corbin

*Attorney, Agent, or Firm*—Arnold, White & Durkee

[57] ABSTRACT

A mechanically stabilized earth wall system, including an upright retaining wall of modular facing panels and a number of horizontal reinforcement units or anchors, including a novel connector to simply and quickly connect the horizontal reinforcement anchors to the modular facing panels.

30 Claims, 4 Drawing Sheets

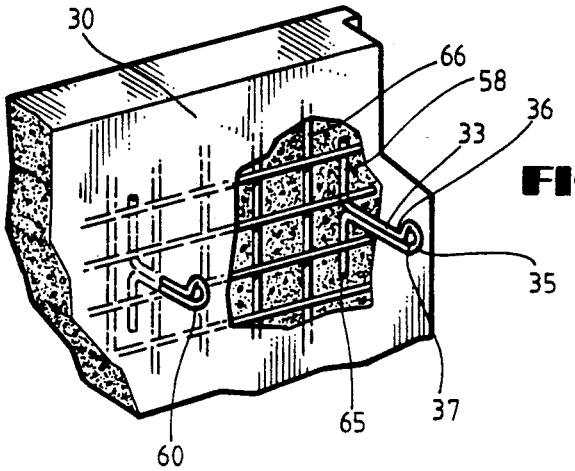
FIG. 3
FIG. 4
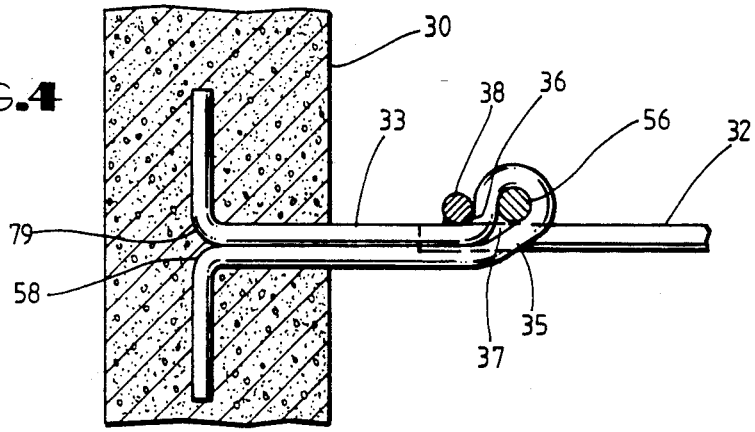
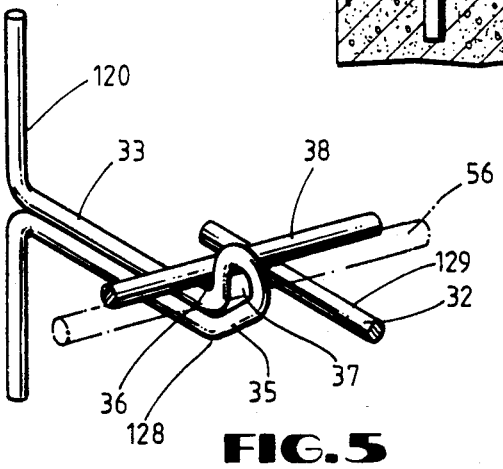
FIG. 5
FIG. 6
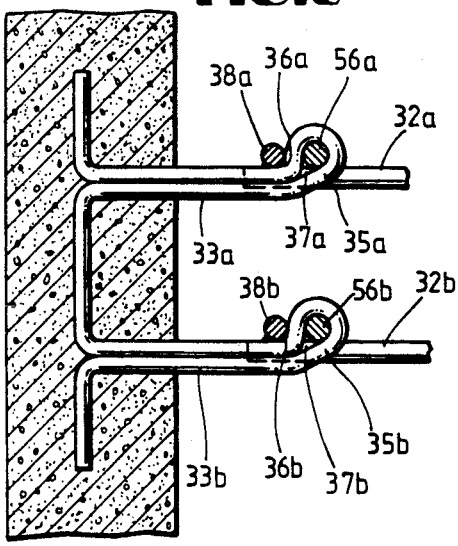

MECHANICALLY STABILIZED EARTH SYSTEM AND METHOD OF MAKING SAME

CROSS-REFERENCE TO RELATED APPLICATIONS

This application is a continuation-in-part of copending U.S. patent application Ser. No. 610,514, filed Nov. 8, 1990, now abandoned.

BACKGROUND OF THE INVENTION

1. Field of the Invention

The present invention relates to mechanically stabilized earth wall structures. The invention more particularly concerns a modular wall or facing panel which interconnects with an anchor which in turn cooperates with backfill or the like to stabilize the panel. The invention is especially directed at a modular wall panel which is precast to include a connector which is quickly and securely connectable to an anchor member.

2. Description of Related Art

A mechanically stabilized earth wall structure comprises a concrete wall facing with earth backfill placed behind the structure. Elongated members extend from the back surface of the wall into the earth backfill to form generally horizontal planes which act as anchors in the backfill. The elongated members may comprise various types of reinforcements or anchors.

Strip reinforcements or strip anchors include strips made of such materials as galvanized steel and plastic. Tensile stresses in the soil or backfill transfer to the strips through friction. Grid anchors comprising tensile resistant grid elements transfer stress to the backfill through passive resistance of transverse elements of the grids and friction between the backfill and laterally disposed surfaces of the grids. The grids in the form of a mesh or web may be made of various materials such as metals and polymer materials. Still other types of anchors include sheet anchors which comprise sheets of geotextiles placed in generally horizontal layers within the backfill.

Several methods and apparatuses have been provided in the past for attaching reinforcement members or anchors to the back surface of modular facing panels. For example, U.S. Pat. No. 4,725,170 discloses a method of connecting elongated wire mesh to interlocking facing wall modules by a means of a clevis and bolt assembly. The U-shaped portion of each clevis is anchored in the modular facing panels during precasting. In one embodiment, the wires in a wire mesh panel are connected to each clevis using a bolt and nut assembly In U.S. Pat. No 4,824,293, connection between a tieback and a modular facing panel is formed by sliding an end of the tieback into a channel preformed in the panel and inserting a rod into the channel to prevent the withdrawal of the tieback.

U.S. Pat. No. 4,449,857 discloses a structure in which wire mesh panels are attached to modular facing panels by means of threaded female fittings anchored in the modular facing panels and threaded male fittings mounted to the end of elongated wires o in the wire mesh panel.

In U.S. Pat. No. 4,324,508, anchor loops are cast within facing panels in a generally vertical disposition to provide horizontally extending passageways. Mats to be covered with backfill have looped ends such that rods extending through the looped ends of the mats and the passages provided by the anchor loops secure the mats to the panels.

Existing systems of stabilizing earth wall structures as reflected by the above references can entail considerable amounts of time and care to properly install such structures. As a result, the costs of installing such systems are frequently very high and the risks of faulty installations can be considerable.

SUMMARY OF THE INVENTION

The present invention addresses the deficiencies in existing systems and provides improved reliability and reduced cost. The invention comprises a system for stabilizing earth wall structures which includes a special modular wall panel that simply and quickly interconnects with one or more anchors, which in turn interact with earth backfill. In one specific aspect, the invention comprises a mechanically stabilized earth wall structure comprising an upright or vertically disposed retaining wall formed from a plurality of interlocking modular facing panels having a front facing, a backfacing, a top, and a bottom.

Each modular facing panel contains at least one lateral array of spaced connectors. Each connector has a first or proximal end which extends into the panel and is anchored in the panel or wall face. This end is preferably precast or otherwise prepositioned in the panel before it is cast or otherwise formed.

A second or distal end of each connector projects from its panel and terminates in an interconnecting member with a quick connect/disconnect feature such as a loop defining a passageway which extends generally parallel to the panel. The passageway or other connect/disconnect feature is separated from the backfacing of the panel by a feature of the connector which serves as a receiving site (between the loop and the retaining wall) for an earth anchor or other anchoring device to be covered by backfill. The receiving site is adapted or configured such that a first end of an earth anchor or other anchoring device will engage or rest on the site and resist movement from the site, especially movement which would disengage the earth anchor from the connector. The earth anchor is laterally disposed. Thus, the distal end of the connector may simply be enlarged to form a knob or shoulder spaced from the wall. The earth anchor is adapted at one end to be placed on the projecting end and abutting the shoulder. The knob or shoulder is designed to resist movement of the earth anchor, placed on the projecting end and abutting the shoulder, off the connector. The connector may also be notched between the distal end of the connector and the panel to receive an end of an anchoring device; or the connector may have a second enlargement spaced from the distal enlargement such that the end of an anchoring device may reside between the two enlargements. The general purpose of the notches, enlargements, or the like is to provide a receiving site for easily and quickly positioning an anchoring device with sufficient permanence for subsequent assembly steps. In a preferred embodiment, the receiving sites are aligned in an array such that a common interlocking mechanism may be employed to lock anchoring devices disposed within backfill to the connectors. For example, a quick connect locking member may be employed to interlock one end in the receiving site by placing the interlocking member within the passageways of the connector.

A preferred form of connector comprises a rod which is angled at its proximal end to be embedded in a panel, looped at its distal end to form a passageway, and bent to form the shoulder. At the point where the connector is proximate to the backfacing of the panel, the longitudinal axis of the connector is substantially perpendicular to the wall. The passageway at the distal end of the connector is vertically offset from this axis and extends generally parallel to the wall. The receiving site comprises a portion of the rod which lies between the looped end and the face of the panel.

Generally the connector comprises a metal rod which is bent at a mid-portion to form a loop defining a passageway and double rod. The two ends of the double rod are then bent to form a tee at the opposite end of the double rod from the looped end.

As mentioned earlier, the projecting or distal end of each connector is configured to provide a quick but reliable connection with a suitable earth anchor. Although the connecting mechanism can be any suitable latching or other interconnecting device which is compatible with the anchor, a preferred mechanism comprises a connector having a receiving site and a passageway in the connector configured to be interlocked with the anchor. In a preferred mechanism, a quick connect locking member is placed through the passageway to lock an earth anchor in place on the receiving site. The passageway can be of various shapes such as a teardrop, rectangle, or triangle.

The anchor comprises a rod, bar or other support member capable of residing on the receiving sites of the connectors. At least a portion of the anchor should clear the connectors and fit below the passageways at the distal ends of the connectors when the support member is residing on the receiving sites. Thus, the grid members of a grid anchor should be clear of the connectors when the support member resides on the receiving sites, and the grid members should also lie below the passageways in the connectors when the support member is so residing. An interconnecting device passing through the passageways can then be above the grid members and alongside or below the support member.

A preferred connector component comprises a passageway which is formed in the projecting or distal end of each connector in a plane which generally includes the axis of the connector. The loop extends vertically away from its connector proper and helps to provide a receiving site between the passageway and the opposite end of the connector. A single rod or other connecting member attached to an anchor may engage an array of such receiving sites and thereby connect to one or more panels at the same time. Preferably, once an anchor has been connected to a wall panel through a plurality of passageways, a locking member is inserted through the passageways to lock the anchor to the connectors and the panel. Preferably, a portion of the anchor readily engages or fits a plurality of receiving sites and is then locked in place by means of a suitable locking member that is placed through the passageways.

In a preferred form of the invention, an array of laterally spaced metal rods or other suitable connectors is precast into the back of a modular facing panel. The first ends or proximal ends of the metal rods are bent in a T-shape and are precast into the panel. The second ends or the distal ends of the rods project from the panel to form loops defining passageways spaced from the backfacing. The number of connectors used vary depending on the height of the mechanically stabilized earth structure. The distal end of each metal connector preferably forms a loop, defining a passageway, which allows a locking member extending through the passageway formed by the loops to lock an end of a grid anchor in place in a receiving site formed between the two ends of the connector. Although this preferred form of the invention uses metal rods, it is contemplated that other suitably strong materials and devices may be used. The placement of the loop on the metal connector is such that, when assembled with the grid anchor and the facing panel, the grid anchor is laterally disposed and generally perpendicular to the facing panel when the grid anchor is in place in a backfill. In addition, the placement of the loop on the metal connector is such as to cause forces pulling on the grid anchor to be substantially perpendicular to the modular facing panel. A key feature of this placement is to even out the load on the modular facing panel.

The rod, bar or other support member of the anchor residing on the receiving sites of the connectors will carry a load that is dependent upon various factors including the size of the panel and the density and depth of the backfill. The load will consist of an axial force acting through the connector. This load will be distributed among the joints between the support member and the grid members of the grid anchor. At some point, this force will exceed the joints' load-bearing capabilities.

The price of any anchor is in direct proportion to the weight of the anchor; that is, the heavier the anchor is, the more materials that are needed to make the anchor and the more expensive it is to ship the anchor. Thus, while the strength of a given earth anchor and connector system is an important factor to consider in deciding the utility of the system, a comparison of the force that the system can withstand as compared to the weight of the earth anchor and connector system may prove more useful. Optimizing this strength-to-weight ratio is important in designing an effective system.

Grid anchors commonly comprise cold drawn steel wire rods which are welded together. The longitudinal grid elements, extending substantially perpendicular to the backfacing of the panel, are commonly spaced 6 inches apart from each other. The latitudinal grid elements, extending substantially parallel to the backfacing of the panel, are commonly spaced 12 inches apart from each other. A grid anchor having members with these spacings can effectively transfer stresses from the rod, bar or other support member to the soil or backfill. Such a grid anchor may be referred to as a 6 by 12 grid ("6×12").

The standard practice in the industry is that the cross-sectional area of the longitudinal grid elements should be at least 60% of the cross-sectional area of the latitudinal grid elements. For example, a grid anchor having longitudinal grid elements with a cross-sectional area of 0.11 square inches and latitudinal grid elements with a cross-sectional area of 0.16 square inches is acceptable (0.11/0.16=0.6875 or 69%), whereas a grid anchor having longitudinal grid elements with a cross-sectional area of 0.09 square inches and latitudinal grid elements with a cross-sectional area of 0.16 square inches is not acceptable (0.09/0.16=0.5625 or 56%).

A preferred form of the anchor comprises a rod, bar or other support member which is permanently joined to a plurality of longitudinal grid members. The axial force acting through the connector is conveyed to the rod, bar or other support member at a point a distance above the joint between the rod, bar or other support member and the grid member, causing a moment around the joint. This moment, acting on the rod, bar or other support member, will tend to roll the rod, bar or other support member around the joint in a direction towards the backfacing of the panel.

This moment will often result in a bending of the ends of the longitudinal grid members proximate the joint with the rod, bar or other support member as the moment tends to roll the rod, bar or other support member. The moment causes the joints between the rod, bar or other support member and the grid members to fail when the axial force in the connectors is less than the force that either the connectors or the longitudinal grid members can withstand in tension. Experimentation has shown that this moment acting on the rod, bar or other support member will cause a failure of the joint or a failure in the grid member proximate the joint.

The rod, bar or other support member of the anchor will not carry a load sufficient to cause a failure of the joint, or a failure in the grid member proximate the joint, in situations where the axial force acting through the connectors is low due to the low density or depth of the backfill above the earth anchor. Thus, when the anchor is located near the top of the earth wall structure, an anchor adapted at one end with a single rod, bar or other support member will be sufficient. A more critical concern when the anchor is located near the top of the earth wall structure is preventing the anchor from moving in the backfill. One way to reduce the likelihood of movement of the anchor in the backfill is to increase the surface area of the latitudinal grid members, such as by using bars instead of rods for those latitudinal grid members. However, if the anchor is located deeper within the earth wall structure, a failure of the joint, or a failure in the grid member proximate the joint, becomes more likely.

Earth anchors are often formed from grid members and support members comprising cold drawn steel wire rods, which have a tensile strength of at least about 70,000 pounds per square inch of the cross-sectional area of the wire rods. Thus, for example, a grid member or support member consisting of a substantially cylindrical shape having a cross-sectional area of 0.11 square inches and being formed from cold drawn steel wire can withstand a force in tension of at least 7700 pounds without failing. A grid anchor can be formed from longitudinal and latitudinal members consisting of cold drawn steel wire rods, each having a cross-sectional area of about 0.11 square inches and a diameter of about 0.374 inches. The longitudinal members typically are attached to the latitudinal members by a resistance weld. Due to the moment acting on the rod, bar or other support element, a resistance weld joint in the grid anchor between two rods, each having a cross-sectional area of 0.11 square inches, can only withstand an axial force of about 3432 pounds when the longitudinal member is proximate a connector. Thus, over 55% of the available tensile strength of the longitudinal grid member is not utilized. The weight of this grid anchor is about 3.15 pounds per latitudinal foot of the anchor. Since the grid anchor is a $6\times12$ grid, there are two joints per latitudinal foot of the anchor The strength-to-weight ratio is, therefore, about 2179 pounds of force per pound of anchor (3432 lbs. of force/joint times 2 joints/ft. divided by 3.15 lbs of weight/ft).

The axial force that the joint can withstand decreases as the distance between the longitudinal member and the connector increases. Therefore, a second connector, formed similarly to the first connector, can be embedded in the panel near the first connector. The second connector is spaced about 0.5 inches from and aligned substantially parallel to the first connector. The rod, bar or other support member of the anchor may quickly and properly be placed on the receiving sites with the longitudinal member proximate a connector by placing the rod, bar or other support member on the receiving sites with the longitudinal member located between the first and second connectors. By spacing the connectors equidistance to the spacing of the longitudinal members, each longitudinal member of the anchor will be situated proximate a connector.

By increasing the cross-sectional area of the latitudinal support member to 0.16 square inches while keeping the longitudinal grid members the same, the area of the joint between the support member and the grid member increases, thus increasing the strength of the joint. At the same time, however, the axial force acting through the connector is conveyed to the rod, bar or other support member at an increased distance above the joint. Therefore, the moment, for the same force, is increased proportionally with the increased distance. This tradeoff results in the joint being capable of withstanding an axial force of about 4672 pounds before the joint fails, meaning over 39% of the tensile strength of the grid member is not utilized. The weight of this grid anchor is about 3.90 pounds per latitudinal foot of the anchor. The strength-to-weight ratio is, therefore, about 2396 pounds of force per pound of anchor.

By increasing the cross-sectional area of each longitudinal grid member to 0.16 square inches, the area of the joint between the latitudinal support member and the longitudinal grid member further increases, thus increasing the strength of the joint. A longitudinal grid member having a cross-sectional area of 0.16 square inches can withstand a force in tension of at least about 11,200 pounds without failing. Because of the moment acting on the joint, the joint is only capable of withstanding an axial force of about 6600 pounds before the joint fails, meaning over 41% of the tensile strength of the grid member is not utilized. The weight of this grid anchor is about 4.90 pounds per latitudinal foot of the anchor. The strength-to-weight ratio is, therefore, about 2694 pounds of force per pound of anchor.

By attaching to the longitudinal grid members a second wire rod parallel to and spaced two inches from the first latitudinal wire rod, which is acting as the support member, and by providing a receiving site capable of receiving both of these rods simultaneously, the force the joint can withstand can be increased. As the force is applied by the connector to the wire rod furthest from the backfacing, the moment tends to roll the rod. As it does, the longitudinal grid members begin to bend. The wire rod closest to the backfacing, since it is already in contact with or proximate the receiving site, tends to inhibit any bending of the longitudinal grid members.

A second preferred anchor for use in the invention is therefore provided at one end with a pair of rods or other support members spaced 2 inches apart from each other, capable of simultaneously residing on the receiving sites of the connectors. A bar having an elongated width which is capable of residing flatly on the receiving sites of the connectors may be used as an alternative to the pair of rods or other support members.

For example, an anchor can be provided with longitudinal cold drawn wire rods of a cross-sectional area of 0.075 square inches and latitudinal cold drawn wire rods of a cross-sectional area of 0.11 square inches. When the anchor is further provided at one end with a pair of 0.11 square inch wire rods spaced two inches apart from each other, each joint may withstand an axial force of about 4835 pounds before the joint fails, which represents a loss of only 8% of the tensile strength of longitudinal grid members. The weight of this grid anchor is about 2.65 pounds per latitudinal foot of the anchor. The strength-to-weight ratio is, therefore, about 3649 pounds of force per pound of anchor.

A second example of this anchor may be provided with longitudinal cold drawn wire rods of a cross-sectional area of 0.11 square inches and latitudinal cold drawn wire rods of a cross-sectional area of 0.14 square inches. When the anchor is further provided at one end with a pair of 0.14 square inch wire rods spaced two inches apart from each other, each joint can withstand an axial force of about 6634 pounds before the joint fails, which represents a loss of only 14% of the tensile strength of longitudinal grid members. The weight of this grid anchor is about 3.42 pounds per latitudinal foot of the anchor. The strength-to-weight ratio is, therefore, about 3880 pounds of force per pound of anchor.

Another preferred connector for use in the invention comprises a metal rod which is angled at its proximal end to be embedded in a panel, looped at its distal end to form a first passageway and bent to form a first shoulder. The rod is further looped between its proximal end and its distal end to form a second passageway and bent to form a second shoulder. The two passageways are preferably in the same plane and extend generally parallel to the wall and each other. A first receiving site comprises a portion of the rod which lies between the first passageway and the second passageway. A second receiving site comprises a portion of the rod which lies between the second passageway and the face of the panel. The distance from the first receiving site at a point proximate the first passageway to the second receiving site at a point proximate the second passageway is preferably equal to the distance between the pair of rods or other support members of the anchor.

Alternatively, a first connector piece can be formed from a metal rod which is angled at its proximal end to be embedded in a panel, looped at its distal end to form a first passageway and bent to form a first shoulder. The receiving site of the first connector piece comprises a portion of the rod which lies between the looped end and the face of the panel. A second connector piece is similarly formed from a metal rod which is angled at its proximal end to be embedded in a panel, looped at its distal end to form a first passageway and bent to form a first shoulder. The receiving site of the second connector piece is shorter than the receiving site of the first connector piece by a length preferably equal to the distance between the two rods or other support members of the second preferred anchor. The tee of the first connector piece is permanently attached to the tee of the second connector piece, so that the tees are proximate each other. At a point proximate the face of the panel, the longitudinal axis of the first connector piece is proximate the longitudinal axis of the second connector piece. Thus, a connector is formed having two passageways in substantially parallel planes. The distance from the first receiving site at a point proximate the first passageway to the second receiving site at a point proximate the second passageway is preferably equal to the distance between the pair of rods or other support members of the anchor.

The invention provides a quick and simple system for installing a mechanically stabilized earth retaining wall. The modular panels may have any suitable periphery and configuration for assembly of the panels to form a wall. In studies of the invention, a panel having twelve sides has been found to be very effective; however, it is contemplated that a variety of designs may be employed. Conventional designs include various shapes and numbers of sides.

Precast concrete panels are especially contemplated for use; however, other suitable materials may be used. Similarly, metal grid-like anchor members and metal connectors appear especially desirable. Concrete panels which are laterally aligned may be connected to a single anchor; however, it is contemplated that separate anchors for separate panels are preferred. Each panel should preferably have a plurality of connectors to serve as a mooring unit for that panel.

The system of the invention may employ a variety of laterally disposed earth anchors. The earth anchor component, for example, may comprise a plurality of linear strips interconnected at a first end of the earth anchor. The strips may comprise metallic or synthetic materials. The earth anchor may also comprise a sheet of synthetic or metallic material. With a grid type earth anchor, the earth anchor may be made of various materials such as metals, polymers, or the like with each material having the characteristics which make it most suitable for a particular application. Each panel, however, will generally require one or more anchors placed in the appropriate areas.

In attaching rods to the anchors, the rods are preferably adapted to fit behind the loops of the connectors between the precast panels and the loops. In some cases, the rods can be already present as integral parts of the anchors. For example, with reinforcing mesh or grid anchors, an edge of the mesh can actually be a rod. Thus, it is only necessary that a locking member be able to fit within each passageway defined by a loop so as to lock the rod behind the loop. The locking member may be round, square, or any other suitable shape.

The unique connecting system of the invention for connecting modular facing panels to reinforcement or anchor units has the unique advantage of reducing the time and labor required in the field, and thus reduces the costs of the system.

BRIEF DESCRIPTION OF THE DRAWINGS

Other objects, features, and advantages of the present invention will become apparent upon a consideration of the following detailed description and the accompanying drawings, in which:

FIG. 3 is a fragmentary perspective and cutaway view of a portion of the modular facing panel and two connectors in one embodiment of the invention.

FIG. 4 is a cross-sectional side view of a modular facing panel with a connector in one embodiment of the invention.

FIG. 5 is a perspective view of a connector with a portion of an anchor and locking member.

FIG. 6 is a cross-sectional side view of a panel and a connector with two anchors locked in receiving sites

DETAILED DESCRIPTION OF THE PREFERRED EMBODIMENTS

The following detailed description illustrates the mechanically stabilized earth wall structure of the present invention. When like elements are described in two or more different figures, like numbers have been used to identify those elements.

Figure 1:
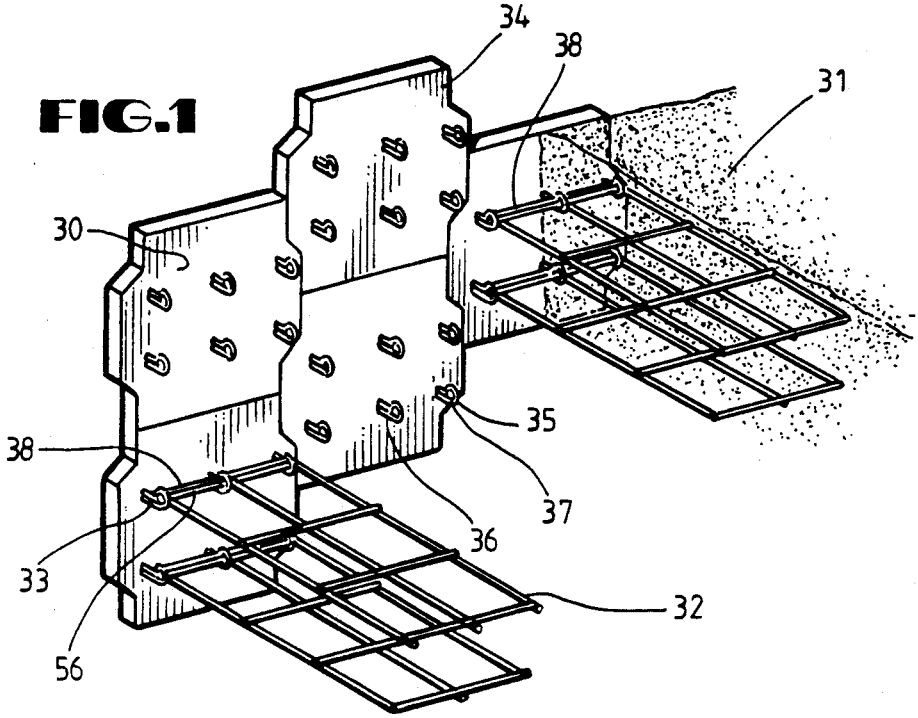
FIG. 1 is a fragmentary perspective view showing part of a retaining wall built with one embodiment of the invention.

Referring to FIG. 1, a mechanically stabilized earth wall structure comprises an upright retaining wall, shown generally at 34. The upright retaining wall 34 is formed from a plurality of modular facing panels 30 with a front facing, a backfacing, a top, and a bottom. The panels may be of any suitable geometric shape and are depicted herein as dodecagon in shape. Each modular facing panel 30 has associated with it one or more lateral arrays of connectors 33 projecting from the panel. Each connector 33 has a first or proximal end extending into the panel 30 and a second or distal end terminating with a loop 35 aligned with corresponding loops 35 in the other connectors 33. Each loop 35 has a passageway 37. A receiving site 36 is located between the first end and the loop 35. The system also comprises a laterally disposed anchor 32. A rod 38 is attached to the anchor 32 and adapted to fit behind each loop on receiving site 36. The connectors 33 and the anchors 32 hold the retaining wall in place to an underlying mass 31, such as earth-to-earth backfill. A locking member, not shown, is configured to fit within the passageway 37 to lock the rod 38 on the receiving site 36.

The anchors 32 may be made of various materials such as metal, glass, polymer or the like with each material having characteristics most suitable for a particular application. The anchor 32 may be in the form of a grid reinforcement unit or grid anchor, as shown in FIG. 1, with similar anchors shown in FIGS. 2, 4, 5, and 6. The grid anchor 32 has a plurality of first parallel members with a first end extending toward the backfacing of the panels 30 and a plurality of second parallel members rigidly attached to the first parallel members in a direction substantially perpendicular to the first parallel members. The rod 38 may be an integral part of the anchor 32. The grid anchor 32 preferably comprises a polymeric or metallic substance. However, the anchor may comprise other structures and materials, as for example, a sheet of a geotextile. The anchor may also comprise a plurality of linear strips with one end of the strips attached to a rod. In any case, as mentioned earlier, a portion of the anchor must be separated from a rod or other anchor support member, when the support member resides on receiving sites 36 of the connectors 33. The separation is effected by the presence of a locking member (not shown) in passageway 37. The grids, sheets, or strips may comprise synthetic materials, metallic materials or some combination thereof.

As shown in FIG. 1, each modular facing panel 30 preferably has a plurality of connectors 33 and anchors 32. The positioning and spacing of the connectors 33 and anchors 32 may be varied, consistent with ready engagement and interlocking of these members. Additionally, the number of connectors may be varied with wall height. Thus, the figures are merely illustrative of the connection of the anchors 32 to the modular facing panel 30 via the connectors 33.

As illustrated, each panel 30 has at least one row or array of connectors 33 with two or more connectors 33 in each row. Each connector 33 has at least one loop 35 having a passageway 37 formed in the connector 33 and a receiving site 36 for each loop. It is contemplated that an anchor 32 may employ connectors 33 which contain two or more loops 35. It is known that the panels 30 can be made from any materials suited for the intended usage, including but not limited to wood, polymer, concrete, or metal. The panels 30 are preferably made in castings, whereupon the connectors 33 are precast into the panels 30.

Figure 2:
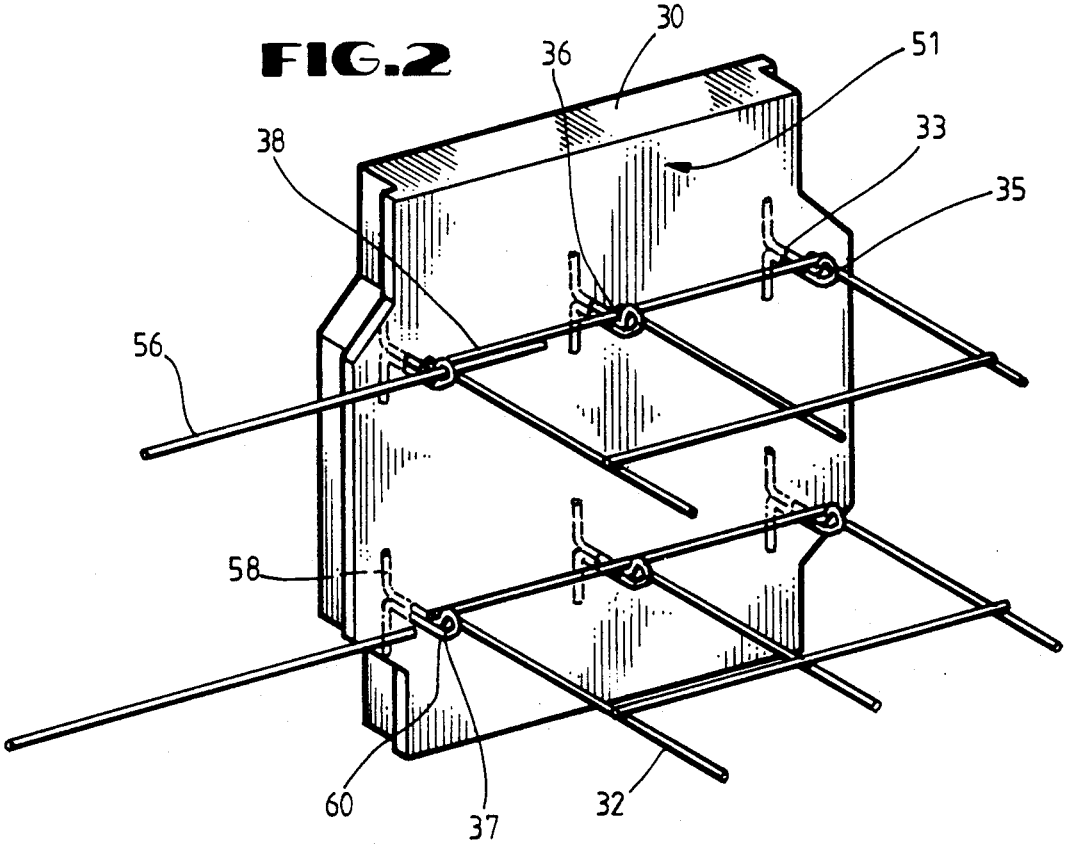
FIG. 2 is a perspective view of a panel with connectors and anchors illustrating one embodiment of the invention.

Referring to FIG. 2, the connectors 33 are precast in arrays into the facing panel 30 in one embodiment. Each connector 33 has a proximal end 58 extending into the backfacing 51 of the modular facing panel 30. A loop 35 is formed on the distal end 60 of the connector 33 extending outward from the backfacing 51. Each loop 35 contains a passageway 37 for receiving a locking member 56. A receiving site 36 is formed on each connector 33 between the loop 35 and the backfacing 51. A laterally disposed anchor 32 includes a rod 38 configured to fit on a receiving site 36. Placing the locking member 56 through the passageway 37 in the loops 35 locks the rod 38 and anchor 32 in place on the receiving site 36. In this embodiment, a preferred locking member 56 is a round galvanized bar.

Referring to FIG. 3, a reinforced modular facing panel 30 shows another embodiment of the invention. Each connector 33 in this embodiment has a proximal end 58 bent in a T-shape 65, which terminates within the modular facing panel 30. The distal end 60 has a loop 35 with a passageway 37 adapted to receive a locking member. A rod with an anchor attached to it placed on the receiving site 36 may thereby be locked in place by means of a locking member placed through the passageway 37. The connector 33 may be placed in a mold for casting the reinforced panel 30, such that the T-shape 65 is behind the wire mesh reinforcing material 66 in the mold.

FIG. 4 shows a cutaway of a modular facing panel 30 with a connector 33 extending into the modular facing panel 30. The connector 33 has a proximal end 58 in alignment with all other proximal ends 58 in an array of spaced connectors 33. Each spaced connector 33 comprises a single rod or wire which has been bent to form a loop 35 at one end and a tee 79 at the opposite end.

The loop 35 in this embodiment is in the shape of a teardrop and has a passageway 37. A receiving site 36 is formed such that a rod 38 connected to an anchor 32 may be placed behind the loop 35 on the receiving site 36 and locked in place by sliding a locking member 56 into the passageway 37. The locking member 56 may be a section of bar, cable, tubing or the like.

One of the advantages of this invention is that the amount of time needed to connect an anchor to a modular facing panel is much less than that needed to connect anchors to facing panels using bolts, sliding anchors into modular facing panels, or placing anchors in keyholes.

FIG. 5 shows a connector 33 formed from a rod bent to form two ends—a tee end 120 and a looped end 128. The tee end 120 is adapted to be anchored in a facing panel and the looped end 128 terminates in the loop 35. The connector 33 has a receiving site 36 formed between the loop 35 and the tee end 120. The receiving site 36 is configured to receive a rod 38 attached to an anchor 32. The loop 35 is bent such that a passageway 37 is formed above the longitudinal axis of the connector 33. The passageway 37 is formed to allow a locking member 56 (in phantom) to be slid into the passageway 37. The passageway 37 is placed such that a locking member 56 placed into the passageway 37 thereby locks in place the rod 38 placed onto the receiving site 36.

It should be noted that the receiving site 36 can be of any shape that will enable an anchor to be placed in a position to be readily interlocked with connectors 33. Thus, an array of receiving sites 36 should be configured to hold a corresponding array of connectors 33 in alignment so as to be interlocked with a common locking member 56.

In a preferred embodiment, the connector 33 is turned over such that the bent loop is facing down instead of up. As a result, the receiving sites 36 also face downward instead of upward. This orientation of the connectors 33 allows for an earth anchor that is locked into place to be raised or lifted at an angle above horizontal.

FIG. 5 also shows the connector 33 with the locking member 56 (in phantom) placed in the passageway 37. The rod 38 attached to an anchor 32 is thereby locked on the receiving site 36 by the locking member 56. The loop 35 is formed such that the rod 38 can be dropped behind the loop 35 onto the receiving site 36. The anchor 32 is constructed to enable the rod 38 to engage its receiving site 36 and yet have the longitudinal members 129 of the anchor 32 clear the passageways 37 of the connectors 33. Thus, the longitudinal members 129 of the anchor 32 can be positioned to one side of the connectors 33.

In FIG. 6, a side view is shown of a dual connector 33*a*, 33*b* with locking members 56*a*, 56*b* and rods 38*a*, 38*b* attached to anchors 32*a*, 32*b* locked in place behind the loops 35*a*, 35*b* on the receiving sites 36*a*, 36*b*. Attachment of laterally disposed anchors is accomplished by including rods 38*a*, 38*b* placed on receiving sites 36*a*, 36*b* and sliding locking members 56*a*, 56*b* into the passageways 37*a*, 37*b* formed in the loops 35*a*, 35*b*. In this embodiment, the loops 35*a*, 35*b* are in the shape of angled tear drops. Locking members 56*a*, 56*b* are adapted to be fitted in the passageways 37*a*, 37*b* formed in the loops 35*a*, 35*b* and prevent the rods 38*a*, 38*b* from moving away from the receiving sites 36*a*, 36*b*. Thus, when the locking members 56*a*, 56*b* are placed through the passageways 37*a*, 37*b* in the loops 35*a*, 35*b*, the arrangement locks the rods 38*a*, 38*b* in place. In this embodiment, the loops 35*a*, 35*b* are in the shape of angled tear drops. The two or more loops 35*a*, 35*b* may be formed in the connector 33*a*, 33*b*.

Figure 7:
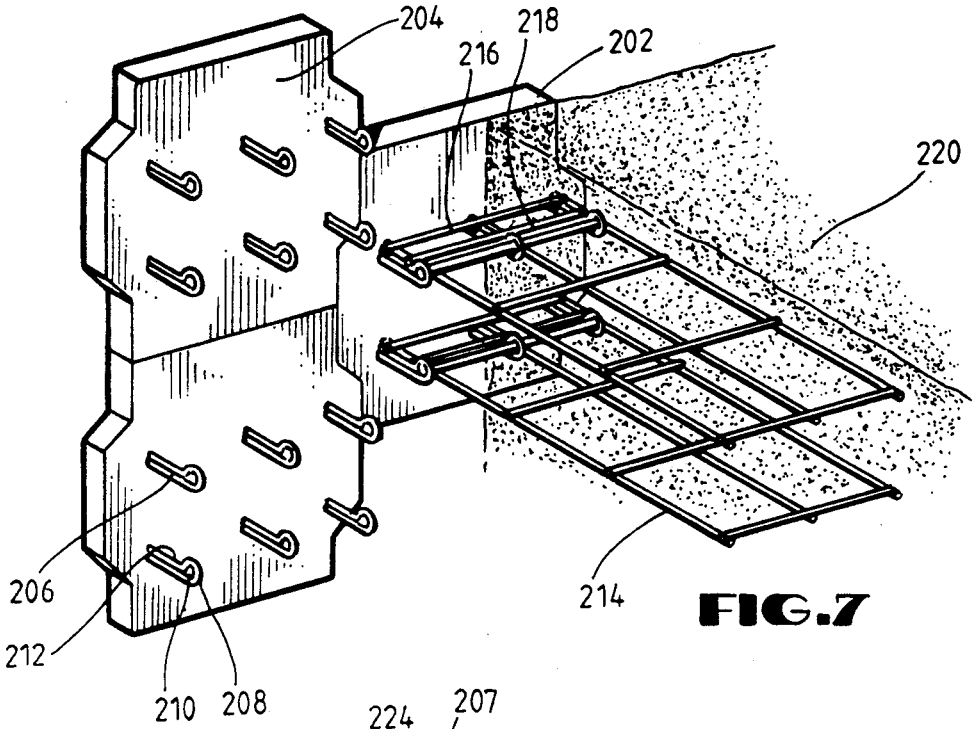
FIG. 7 is a fragmentary perspective view showing part of a retaining wall built with one embodiment of the invention.

Referring to FIG. 7, another mechanically stabilized earth wall structure is shown, comprising an upright retaining wall, shown generally at 202. The upright retaining wall 202 is formed from a plurality of modular facing panels 204 with a front facing, a backfacing, a top, and a bottom. The panels may be of any suitable geometric shape and are depicted herein as dodecagon in shape. Each modular facing panel 204 has associated with it one or more lateral arrays of connectors 206 projecting from the panel. Each connector 206 has a first or proximal end extending into the panel 204 and a second or distal end terminating with a loop 208 aligned with corresponding loops 208 in the other connectors 206. Each loop 208 has a passageway 210. A receiving site 212 is located between the first end and the loop 208. The receiving site 212 in FIG. 7 is longer than the receiving site 36 in FIG. 1, so that receiving site 212 can simultaneously receive both rods 216, 218. The system also comprises a laterally disposed anchor 214. Two rods 216, 218 are attached to the anchor 214 and adapted to fit simultaneously behind each loop on receiving site 212. The connectors 206 and the anchors 214 hold the retaining wall in place to an underlying mass 220, such as earth-to-earth backfill. A locking member, not shown, is configured to fit within the passageway 210 to lock the rods 216, 218 on the receiving site 212.

Similarly to the anchors 32 in FIG. 1, the anchors 214 in FIG. 7 may be made of Various materials such as metal, glass, polymer or the like with each material having characteristics most suitable for a particular application. The anchor 214 may be in the form of a grid reinforcement unit or grid anchor, as shown in FIG. 7, with similar anchors shown in FIGS. 8, 9, 10, 11, and 12. The grid anchor 214 has a plurality of first parallel members with a first end extending toward the backfacing of the panels 204 and a plurality of second parallel members rigidly attached to the first parallel members in a direction substantially perpendicular to the first parallel members. The rods 216, 218 may be an integral part of the anchor 214. The grid anchor 214 preferably comprises a polymeric or metallic substance. However, the anchor may comprise other structures and materials, as for example, a sheet of a geotextile. The anchor may also comprise a plurality of linear strips with one end of the strips attached to the rods 216, 218. In any case, a portion of the anchor must be separated from the rods 216, 218 or other support members, when the rods 216, 218 or other support members are simultaneously residing on receiving sites 212 of the connectors 206. The separation is effected by the presence of a locking member in passageway 210. The grids, sheets, or strips may comprise synthetic materials, metallic materials or some combination thereof.

As shown in FIG. 7, each modular facing panel 204 preferably has a plurality of connectors 206 and anchors 214. The positioning and spacing of the connectors 206 and anchors 214 may be varied, consistent with ready engagement and interlocking of these members. Additionally, the number of connectors may be varied with wall height. Thus, the figures are merely illustrative of the connection of the anchors 214 to the modular facing panel 204 via the connectors 206.

As illustrated, each panel 204 has at least one row or array of connectors 206 with two or more connectors 206 in each row. Each connector 206 has at least one loop 208 having a passageway 210 formed in the connector 206 and a receiving site 212 for each loop 208. It is contemplated that an anchor 214 may employ connectors 206 which contain two or more loops 208. It is known that the panels 204 can be made from any materials suited for the intended usage, including but not limited to wood, polymer, concrete, or metal. The panels 204 are preferably made in castings, whereupon the connectors 206 are precast into the panels 204.

Figure 8:
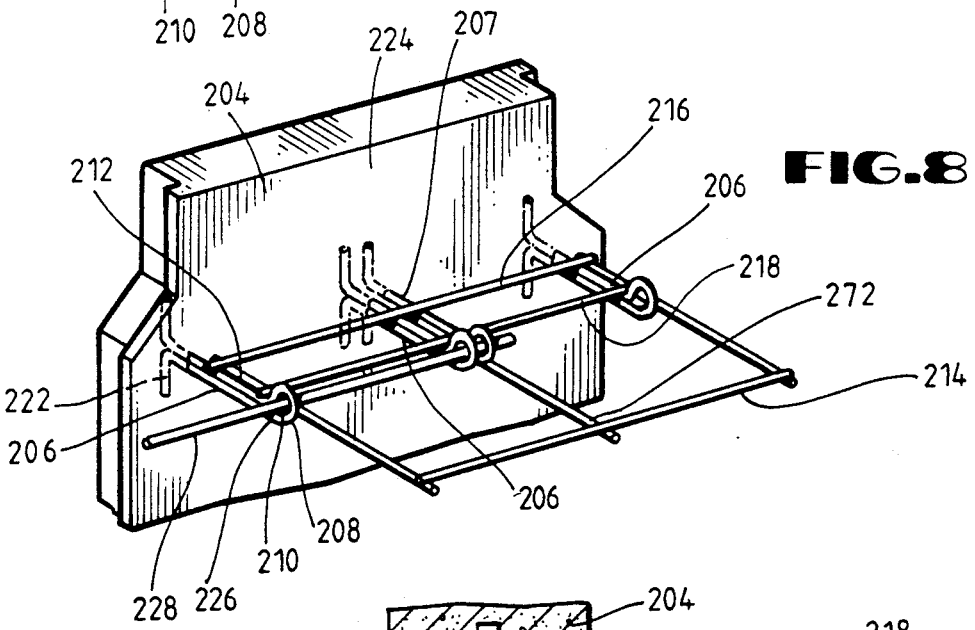
FIG. 8 is a fragmentary perspective and cutaway view of a portion of the modular facing panel and three connectors in one embodiment of the invention.

Referring to FIG. 8, the connectors 206 are precast in arrays into the facing panel 204 in one embodiment. Each connector 206 has a proximal end 222 extending into the backfacing 224 of the modular facing panel 204. A loop 208 is formed on the distal end 226 of the connector 206 extending outward from the backfacing 224. Each loop 208 contains a passageway 210 for receiving a locking member 228. A receiving site 212 is formed on each connector 206 between the loop 208 and the backfacing 224. A laterally disposed anchor 214 includes two rods 216, 218 configured to fit simultaneously on a receiving site 212. Placing the locking member 228 through the passageway 210 in the loops 208 locks the rods 216, 218 and anchor 214 in place on the receiving site 212. In this embodiment, a preferred locking member 228 is a round galvanized bar.

FIG. 8 shows a modular facing panel 204 in another embodiment of the invention. Each connector 206 in this embodiment has a proximal end 222 bent in a T-shape, the proximal end 222 terminating within the modular facing panel 204. The distal end 226 has a loop 208 with a passageway 110 adapted to receive a locking member 228. A pair of rods 216, 218 or other support members, Which are attached to anchor 214, are placed on the receiving site 212 and locked in place by means of a locking member 228 placed through the passageway 210. A second connector 207 is similar to the middle connector 206, which is located in the middle of the array of the three connectors 206. The second connector 207 can be mounted 0.5 inches from the middle connector 206. The longitudinal member 272 of the anchor 214 is then inserted between the middle connector 206 and the second connector 207. The distal end 222 of the connector 206 may be placed in a mold for casting the reinforced panel 204.

Figure 9:
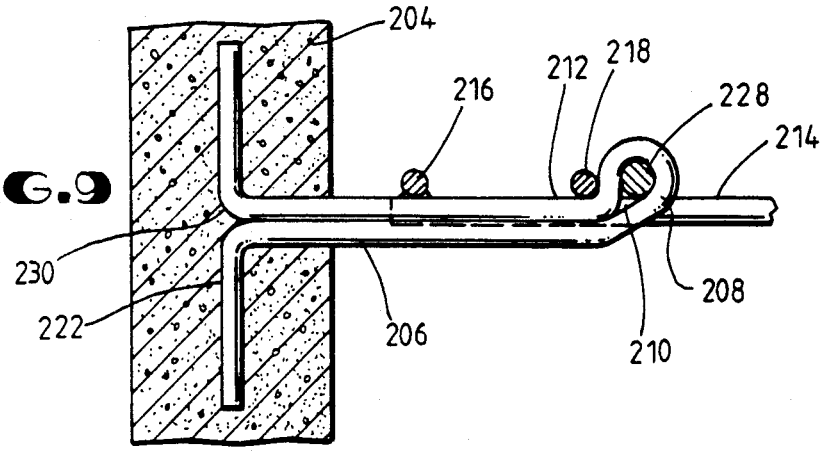
FIG. 9 is a cross-sectional side view of a modular facing panel with a connector in one embodiment of the invention.

FIG. 9 shows a cutaway of a modular facing panel 204 with a connector 206 extending into the modular facing panel 204. The connector 206 has a proximal end 222 in alignment with all other proximal ends 222 in an array of spaced connectors 206. Each spaced connector 206 comprises a single rod or wire which has been bent to form a loop 208 at one end and a tee 230 at the opposite end.

The loop 208 in this embodiment is in the shape of a teardrop and has a passageway 210. A receiving site 212 is formed such that a pair of rods 216, 218 or other support members connected to an anchor 214 may be placed behind the loop 208 on the receiving site 212 and locked in place by sliding a locking member 228 into the passageway 210. The locking member 228 may be a section of bar, cable, tubing or the like.

Figure 10:
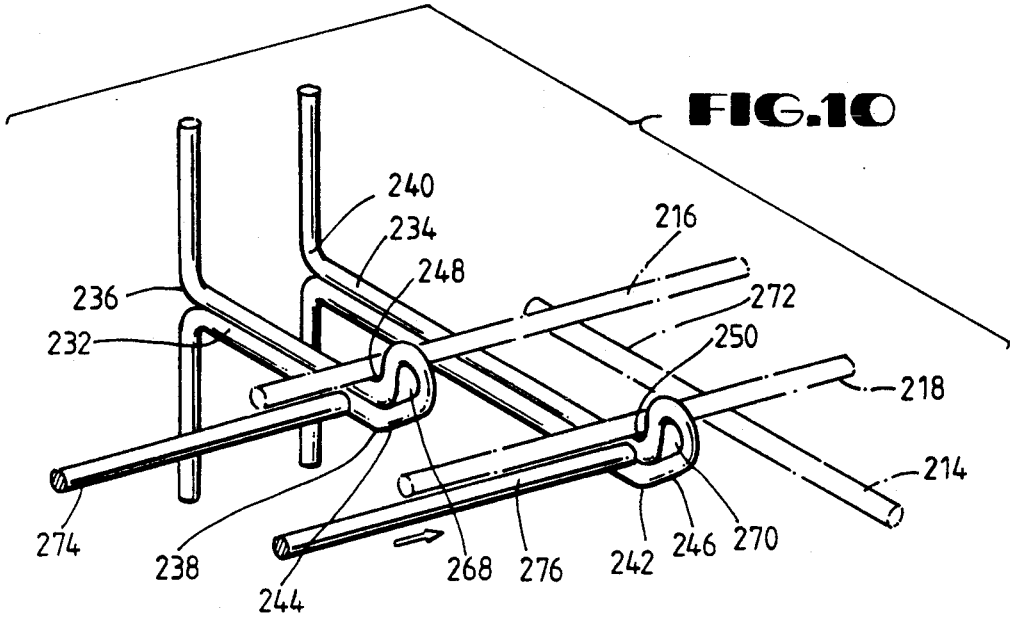
FIG. 10 is a perspective view of a connector constructed from two separate pieces with a portion of an anchor and locking member.

FIG. 10 shows a connector formed from two separate pieces 232, 234. Piece 232 is formed from a rod bent to form two ends: a tee end 236 and a looped end 238. Piece 234 is similarly formed from a rod bent to form two ends: a tee end 240 and a looped end 242. Each of the tee ends 236, 240 is adapted to be anchored in a facing panel. The looped end 238 of piece 232 terminates in a loop 244. Likewise, the looped end 242 of piece 234 terminates in a loop 246.

Piece 232 has a receiving site 248 formed between the loop 244 and the tee end 236. Similarly, piece 234 has a receiving site 250 formed between the loop 246 and the tee end 240. Piece 232 is formed from a shorter rod than is piece 234. This results in the receiving site 248 of piece 232 being located closer than the receiving site 250 of piece 234 to the backfacing of the panel when the tee ends 236, 240 are anchored at an equal depth in the panel.

Receiving site 248 is configured to receive a first rod 216 or other support member attached to an anchor 214. Receiving site 250 is configured to receive a second rod 218 or other support member attached to the anchor 214. The loops 244, 246 are bent such that two passageways 268, 270 are formed above the axis of the two pieces 232, 234 of the connector. The two passageways 268, 270 are likewise formed to be above the longitudinal member 272 of the anchor 214 when the rods 216, 218 or other support members of the anchor 214 are residing on the receiving sites 248, 250. Thus, the passageways 268, 270 are located such that a pair of locking members 274, 276 may be placed into the passageways 268, 270, thereby locking the rods 216, 218 or other support members in place on the receiving sites 248, 250 respectively.

The receiving sites 248, 250 can be of any shape that will enable an anchor to be placed in a position to be readily interlocked with each of the two pieces 232, 234 of the connectors in the array. Thus, an array of receiving sites 248, 250 should be configured to hold the corresponding pieces 232, 234 of the array of connectors in alignment so as to be interlocked with common locking members 274, 276.

FIG. 10 also shows the pieces 232, 234 of the connector with the locking members 274, 276 ready to be slidably placed in the passageways 268, 270. The rods or other support members 216, 218 attached to an anchor 214 are thereby locked on the receiving sites 248, 250 by the locking members 274, 276. The loops 244, 246 are formed such that the rods or other support members 216, 218 can be dropped behind the loops 244, 246 onto the receiving sites 248, 250. The anchor 214 is constructed to enable the rods 216, 218 or other support members to engage their respective receiving sites 248, 250 and yet have the longitudinal members 272 of the anchor 214 clear the passageways 268, 270 of the pieces 232, 234 of the connectors. Thus, the longitudinal members 272 of the anchor 214 can be positioned to one side of or between the pieces 232, 234 of the connector.

FIG. 10 also shows the pieces 232, 234 separated by a distance from each other. The pieces 232, 234 can be anchored in the panel such that the tee ends 236, 240 are located proximate each other, with the pieces 232, 234 situated substantially parallel to and proximate each other out of the panel.

Figure 11:
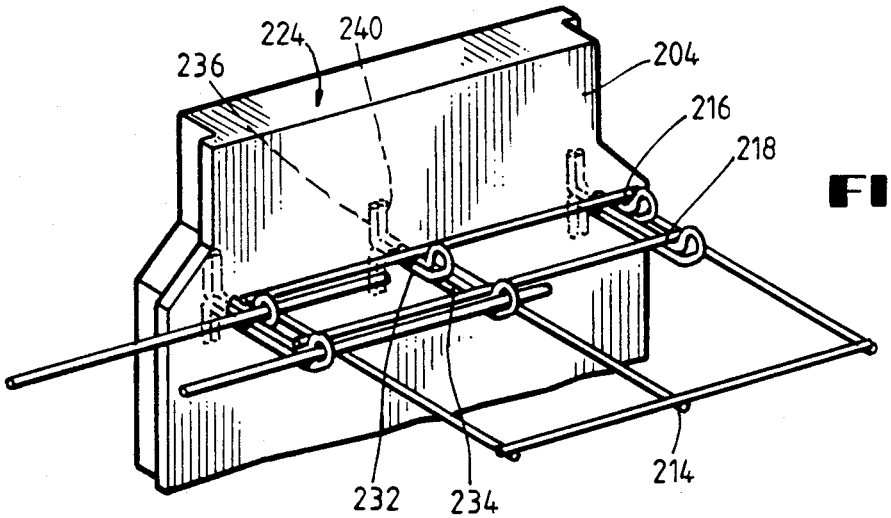
FIG. 11 is a fragmentary perspective and cutaway view of a portion of the modular facing panel with three connectors, each connector constructed from two separate pieces, in one embodiment of the invention.

FIG. 11 shows the embodiment of the pieces 232, 234 of the connectors of FIG. 10, as mounted in a modular facing panel 204. Tee ends 236, 240 of pieces 232, 234 are located and mounted proximate each other in the panel 204. The pieces 232, 234 run substantially parallel to and proximate each other and pieces 232, 234 run substantially perpendicular to the backfacing 224 of the panel 204.

Figure 12:
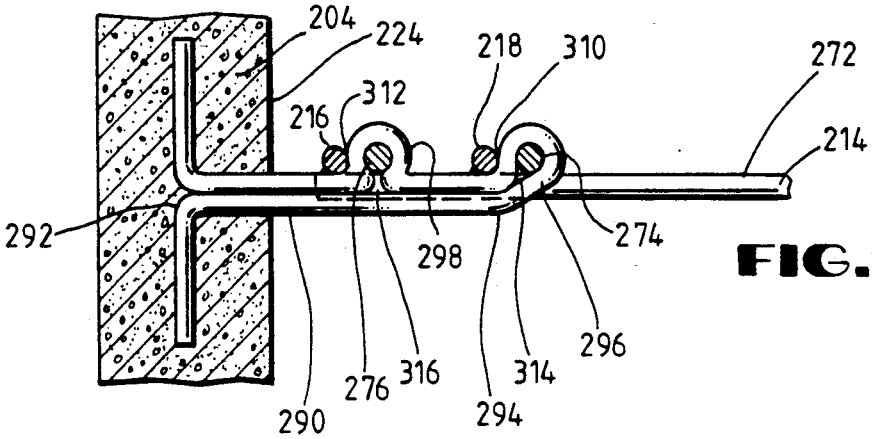
FIG. 12 is a cross-sectional side view of a modular facing panel with a connector in one embodiment of the invention.

Referring to FIG. 12, a cutaway of a modular facing panel 204 shows another embodiment of the invention. The anchor 214 is provided with two rods 216, 218 or other support members. The connector 290 is formed from a rod bent to form two ends: a tee end 292 and a looped end 294. The tee end 292 is adapted to be anchored in a facing panel 204. The looped end 294 terminates in a first loop 296. The rod of connector 290 is further formed to provide a second loop 298 between the first loop 296 and the backfacing 224 of the panel 204.

A first receiving site 310 is formed between the first loop 296 and the second loop 298. A second receiving site 312 is formed between the second loop 298 and the backfacing 224 of the panel 204. The first receiving site 310 is configured to receive the second rod 218 or other support member attached to the anchor 214. The second receiving site 312 is configured to receive the first rod 216 or other support member attached to the anchor 214. The first loop 296 is formed to provide a passageway 314. The second loop 298 is likewise formed to provide a passageway 316. The loops 296, 298 are bent such that the two passageways 314, 316 are formed above the longitudinal axis of the connector 290. The two passageways 314, 316 are likewise formed to be above the longitudinal member 272 of the anchor 214 when the rods 216, 218 or other support members of the anchor 214 are residing on the receiving sites 310, 312. Thus, the passageways 314, 316 are located such that a pair of locking members 274, 276 may be placed into the passageways 314, 316, thereby locking the rods 216, 218 or other support members in place on the receiving sites 310, 312 respectively.

In constructing components for a mechanically stabilized earth structure, a plurality of connectors are formed, each with a first end adapted to be anchored in a modular facing panel, a second end terminating in a passageway, and a receiving site capable of receiving one end of an earth anchor. In forming the connectors, the second ends of rod-like connectors can terminate in loops having the shape of tear drops and defining passageways. The first ends of the connectors can terminate in a tee or other suitable shape capable of being anchored or lodged within the modular facing panel.

The connectors can have a second loop defining a second passageway. This second loop is located between the surface of the modular facing panel and the first loop. In this configuration, the connector has one receiving site located between the first loop and the second loop and another receiving site located between the second loop and the surface of the panel. Alternately, connectors can be constructed having loops and receiving sites located at different distances from the first end of the connector. Thus, when the first end of the connectors are anchored in an array in the modular facing panel, the loops and receiving sites will align themselves into two distinct rows, each of the two rows being a certain distance from the surface of the modular facing panel.

In casting a plurality of modular facing panels having a front facing and a backfacing, each of the modular facing panels is configured or otherwise provided with means for assembling the modular facing panels in an upright wall in an interlocking fashion. Prior to casting, however, one or more of mooring units comprising the above connectors are placed in each of the modular facing panels so that the second ends of the rod-like connectors and their loops extend outwardly from the backfacing of the panel.

Anchors for use with the above connectors are preferably formed with each anchor having two ends, a plurality of first parallel members, and a plurality of second parallel members rigidly attached to the first parallel members and perpendicular to the first parallel members to form a grid. The anchors are preferably elongated and generally rectangular in shape. A first rod is then rigidly attached to one end of the anchor for interlocking that end of the anchor with the mooring units. When using a grid anchor, the attachment of this first rod to the anchor can be skipped since one end of the grid, itself, can suitably serve as a rod. A second rod can be rigidly attached to the one end of the anchor, parallel to the first rod and spaced approximately two inches apart from the first rod.

After constructing the components, a wall can be assembled by interlocking a plurality of the modular facing panels, placing backfill on the back side of the wall up to a level below the array of connectors in the mooring units, attaching anchors to the mooring units locking the anchors to the mooring units by placing locking members into the loops of the connectors, and covering the anchors with backfill. The desired height of the earth wall structure can be attained by assembling lateral rows of panels, one on top of another. The length of the wall structure can be attained simply by extending the lateral rows.

Another embodiment includes a modular wall panel for assembly into a wall made up of such modular wall panels, which comprises a panel having opposed faces; an array of connectors extending in spaced relation across a first of said faces, each connector having a first end configured to be anchored in the panel and a second end defining a first passageway extending generally parallel to the first face and in alignment with the corresponding passageways of adjacent connectors in the array. A second passageway, located between the first passageway and the first face, can also be useful. The second passageway extends generally parallel to the first face and is in alignment with the corresponding second passageways of adjacent connectors in the array. The passageways are offset from their respective longitudinal axes of the connectors proximate the surface of the panel along the first face. The modular wall panel may be concrete pre-cast with the first ends of said connectors in the concrete. The second end of each connector extends transverse to the array to define a shoulder on the connector.

Another embodiment comprises a modular wall panel for assembly into a wall made up of a plurality of such modular wall panels, which comprises a precast concrete panel having first and second opposed faces; a rod-like connector anchored at a proximal end in the first face and projecting from the first face generally normal to the first face to terminate in a distal end spaced from the first face; and a first passageway in the distal end extending generally parallel to the first face. A second passageway, located between the first passageway and the first face, can also be useful. The second passageway extends generally parallel to the first face. The distal end is offset from the connector and is looped to define said passageway. The proximal end is tee-shaped.

The description of the present invention has been presented for purposes of illustration and description, but is not intended to be exhaustive or limit the invention in the precise form disclosed. For example, although the locking members shown in the figures are in the shape of a round bar, other shapes and forms may be used, e.g., a square bar. Also, the rod at one end of the anchors may actually be part of the anchors. For example, in a grid anchor one edge of the grid can serve as the rod for placement on a receiving site. Obviously, many modifications and variations will be apparent to practitioners skilled in this art. A particular embodiment was chosen and described in order to best explain the principles of the invention and its practical application to enable others skilled in the art to understand the invention for various uses and with various modifications as are suited to the particular use contemplated.

What is claimed is:

1. A wall structure for mechanically stabilizing an earth wall structure comprising:

(a) an upright retaining wall comprising at least one laterally disposed, interlocked array of interlocking modular facing panels having a front facing, a backfacing, a top, and a bottom;

(b) at least one laterally disposed array of spaced connectors projecting from said backfacing of each said panel, each connector having a first end anchored in said panel, a second end defining a passageway aligned with corresponding passageways in said array of connectors and a receiving site formed between the backfacing and said second end;

(c) a laterally disposed earth anchor comprised of a plurality of linear stripe interconnected at said first end of the earth anchor and extending away from the retaining wall, said first end of said earth anchor is provided with a first rod-like element generally parallel to said passageways and adapted to interconnect said linear strips and to fit on at least some of said receiving sites in said array of connectors; and (d) a quick connect member configured to lock said anchor on its respective receiving sites and to interlock said earth anchor and the connectors associated with said respective receiving sites by passing through the passageways of the associated connectors.

2. The apparatus of claim 1 wherein said first end of each said connector forms a tee.

3. The apparatus of claim 1 wherein each connector has a longitudinal axis running through said connector at a point proximate said backfacing and said second end comprises a loop vertically offset from said longitudinal axis of said connector to define said passageway.

4. The apparatus of claim 3 wherein the passageway defined by the loop has a tear-drop shape.

5. The apparatus of claim 1 further comprising a second rod-like element spaced from and generally parallel to said first rod-like element, said second rod-like element interconnecting said linear strips and adapted to fit on at least some of said receiving sites in said array of connectors between said first rod-like element and said passageways.

6. The apparatus of claim 1 wherein said strips of said earth anchor comprise a synthetic material or metallic material.

7. The apparatus of claim 1 wherein said earth anchor comprises a grid anchor.

8. The apparatus of claim 1 having a plurality of said earth anchors to be placed on a plurality of said receiving sites in said array of connectors.

9. The apparatus of claim 1 in which said modular panels are concrete pre-cast with said first ends of said connectors in the concrete.

10. The apparatus of claim 1 in which the second end of each connector defines a shoulder on the connector.

11. The apparatus of claim 5 wherein said first end of each said connector forms a tee.

12. The apparatus of claim 5 wherein each connector has a longitudinal axis running through said connector at a point proximate said backfacing and said second end comprises a loop vertically offset from said longitudinal axis of said connector to define said passageway.

13. The apparatus of claim 12 wherein the passageway defined by the loop has a tear-drop shape.

14. The apparatus of claim 5 wherein said strips of said earth anchor comprise a synthetic material or metallic material.

15. The apparatus of claim 5 wherein said earth anchor comprises a grid anchor.

16. The apparatus of claim 5 in which said modular panels are concrete pre-cast with said first ends of said connectors in the concrete.

17. The apparatus of claim 5 in which the second end of each connector defines a shoulder on the connector.

18. The apparatus of claim 5 having a plurality of said earth anchors to be placed on a plurality of said receiving sites in said array of connectors.

19. A wall structure for mechanically stabilizing an earth wall structure comprising:

(a) an upright retaining wall comprising at least one laterally disposed, interlocked array of interlocking modular facing panels having a front facing, a backfacing, a top, and a bottom;

(b) at least one laterally disposed array of spaced connectors projecting from said backfacing of each said panel, each connector having a first end anchored in said panel, a second end defining a passageway aligned with corresponding passageways in said array of connectors and a receiving site formed between the backfacing and said second end;

(c) a laterally disposed earth anchor comprised of a plurality of linear strips interconnected at said first end of the earth anchor and extending away from the retaining wall, said first end of said earth anchor is provided with a bar-like element generally parallel to said passageway and having upper and lower opposed faces, said bar-like element adapted to interconnect said linear strips and to fit on at least some of said receiving sites in said array of connectors; and (d) a quick connect member configured to lock said anchor on its respective receiving sites and to interlock said earth anchor and the connectors associated with said respective receiving sites by passing through the passageways of the associated connectors.

20. The apparatus of claim 19 wherein said first end of each said connector forms a tee.

21. The apparatus of claim 19 wherein each connector has a longitudinal axis running through said connector at a point proximate said backfacing and said second end comprises a loop vertically offset from said longitudinal axis of said connector to define said passageway.

22. The apparatus of claim 21 wherein the passageway defined by the loop has a tear-drop shape.

23. The apparatus of claim 19 wherein said strips of said earth anchor comprise a synthetic material or metallic material.

24. The apparatus of claim 19 wherein said earth anchor comprises a grid anchor.

25. The apparatus of claim 19 in which said modular panels are concrete pre-cast with said first ends of said connectors in the concrete.

26. The apparatus of claim 19 in which the second end of each connector defines a shoulder on the connector.

27. The apparatus of claim 19 having a plurality of said earth anchors to be placed on a plurality of said receiving sites in said array of connectors.

28. A wall structure for mechanically stabilizing an earth wall structure comprising:

(a) an upright retaining wall comprising at least one laterally disposed, interlocked array of interlocking modular facing panels having a front facing, a backfacing, a top, and a bottom;

(b) a laterally disposed array of spaced connectors projecting from said backfacing of each said panel, each connector having a first end anchored in said panel, a second end defining a first passageway aligned with corresponding first passageways in said array of connectors, said connector providing a second passageway between and spaced from both said backfacing and said first passageway, said second passageway aligned with corresponding second passageways in said array of connectors, a first receiving site formed between said first passageway and said second passageway in alignment with corresponding first receiving sites in said array of connectors, and a second receiving site formed between said second passageway and said backfacing in alignment with corresponding second receiving sites in said array of connectors;

(c) a laterally disposed earth anchor including a first support member at a first end and a second support member proximate said first support member, said first support member adapted to fit on at least some of said second receiving sites in said array of connectors and said second support member adapted to fit on at least some of said first receiving sites in said array of connectors; and (d) a first and a second quick connect member, said first quick connect member configured to lock said first support member on said second receiving sites and to interlock said earth anchor and the connectors associated with said second receiving sites by passing through said second passageways and said second quick connect member configured to lock said second support member on said first receiving sites and to interlock said earth anchor and the connectors associated with said first receiving sites by passing through said first passageways.

29. A wall structure for mechanically stabilizing an upright, retaining earth wall, said wall structure comprising:

(a) at least one laterally disposed, interlocked array of interlocking modular facing panels having a front facing, a back facing, a top, and a bottom;

(b) a laterally disposed array of spaced connectors projecting from said back facing of each said panel with each said connector having a longitudinal axis running through said connector at a point proximate said back facing;

(c) each said connector having a first end anchored in said panel and a second end defining a first passageway vertically offset from said longitudinal axis of said connector and aligned with corresponding first passageways in said array of connectors;

(d) each said connector also defining a second passageway vertically offset from said longitudinal axis of said connector, positioned between and spaced from both said back facing and said first passageway of said connector, and aligned with corresponding second passageways in said array of connectors;

(e) a first receiving site on each connector vertically intermediate said connector and said first and second passageways, laterally between said first and second passageways and in alignment with corresponding first receiving sites in said array of connectors;

(f) a second receiving site on each connector vertically intermediate said connector and said first and second passageway, laterally between said back facing and said second passageway of said connector and in alignment with corresponding second receiving sites in said array of connectors;

(g) a laterally disposed earth anchor having a first end extending along said array of connectors, said earth anchor having at least two longitudinal elements;

(h) first and second spaced anchor support members extending along said first end of said earth anchor and spaced from one another to engage said second and first receiving sites of said array of connectors, respectively, said anchor support members being attached to said longitudinal elements such that said longitudinal elements are positioned on the opposite side of said receiving site from said first and second passageways; and (i) separate, elongated locking members adapted to be inserted through said aligned first and second passageways thereby locking said earth anchor to said connectors.

30. A modular panel for assembly in a lateral array of such panels for use together with an earth anchor having a support member extending along one end of the earth anchor in stabilizing an earth structure, said modular panel comprising:

(a) a front face, a back face, a top and a bottom when said panel is assembled in said array of panels;

(b) an array of elongated connectors secured at corresponding first ends in said panel with each said connector having a longitudinal axis running through said connector at a point proximate said back face;

(c) said array of elongated connectors spaced laterally across said panel, projecting generally perpendicular to said back face of said panel, and terminating at their second ends in aligned, lateral passageways offset vertically from said longitudinal axes of said connectors and configured to receive a common rod-like member;

(d) a receiving site on the same side vertically of each connector as said passageway of said connector, aligned with the corresponding receiving sites of said other connectors, and configured to receive and align said support member of an earth anchor in cooperation with said receiving sites of said other connectors in said array of connectors such that said earth anchor and said connectors are on the same side vertically relative to said passageways.

* * * * *

UNITED STATES PATENT AND TRADEMARK OFFICE

CERTIFICATE OF CORRECTION

PATENT NO. : 5,259,704

DATED : November 9, 1993

INVENTOR(S) : John M. Orgorchock

It is certified that error appears in the above-identified patent and that said Letters Patent is hereby corrected as shown below:

On the title page, item [75]: Inventor's last name should be changed from "Orgorchock" to -- Ogorchock --.

Signed and Sealed this

Ninth Day of September, 1997

*Attest:*

*Attesting Officer*

BRUCE LEHMAN

*Commissioner of Patents and Trademarks*